US009789883B2

(12) United States Patent
Shi et al.

(10) Patent No.: US 9,789,883 B2
(45) Date of Patent: Oct. 17, 2017

(54) TWO-LEVEL LOCKING DEVICE, HOPPER CAR BOTTOM DOOR AND HOPPER CAR

(71) Applicant: CRRC Yangtze Corporation Limited, Wuhan (CN)

(72) Inventors: Chunjiang Shi, Wuhan (CN); Mingdao Sun, Wuhan (CN); Qiangjun Jiang, Wuhan (CN); Fengwei Liu, Wuhan (CN); Baolei Wang, Wuhan (CN); Wenliang Liu, Wuhan (CN); Chuqiang Tang, Wuhan (CN); Ruijin Jiang, Wuhan (CN); Liangcai Lin, Wuhan (CN); Tiejun Fu, Wuhan (CN)

(73) Assignee: CRRC Yangtze Corporation Limited, Wuhan (CN)

( * ) Notice: Subject to any disclaimer, the term of this patent is extended or adjusted under 35 U.S.C. 154(b) by 152 days.

(21) Appl. No.: 14/758,705

(22) PCT Filed: Nov. 6, 2014

(86) PCT No.: PCT/CN2014/090410
§ 371 (c)(1),
(2) Date: Jun. 30, 2015

(87) PCT Pub. No.: WO2015/070720
PCT Pub. Date: May 21, 2015

(65) Prior Publication Data

US 2015/0353102 A1 Dec. 10, 2015

(30) Foreign Application Priority Data

Nov. 15, 2013 (CN) ..... 2013 1 0571353

(51) Int. Cl.
*B61D 7/26* (2006.01)

(52) U.S. Cl.
CPC ..... *B61D 7/26* (2013.01)

(58) Field of Classification Search
CPC ... B61D 7/00; B61D 7/02; B61D 7/04; B61D 7/12; B61D 7/14; B61D 7/16; B61D 7/22; B61D 7/24; B61D 7/26; B61D 7/32
See application file for complete search history.

(56) References Cited

U.S. PATENT DOCUMENTS 3,625,159 A * 12/1971 Radey ..... B61D 7/30 105/251
3,706,287 A 12/1972 Fritz

* cited by examiner

*Primary Examiner* — R. J. McCarry, Jr.
(74) *Attorney, Agent, or Firm* — Kolisch Hartwell, P.C.

(57) ABSTRACT

The present invention discloses a two-level locking device, a hopper car bottom door and a hopper car. The device includes a first transmission shaft, a second transmission shaft, a clutch, a pressure mechanism and a reset mechanism, wherein under the pressure action of the pressure mechanism, the clutch separates the first transmission shaft from the second transmission shaft, and under the action of the reset mechanism, the clutch joints the first transmission shaft with the second transmission shaft. The bottom door includes the device. The hopper car includes the bottom door. By adopting the device, when the clutch is accidently separated by the pressure action of the pressure mechanism, the reset mechanism can re-joint the clutch to prevent the accidental rotation of the first transmission shaft and the second transmission shaft. By adopting the bottom door, the hopper car bottom door opened and closed by a planar four-bar linkage passing a dead point is more reliable to use. The hopper car is more reliable to use.

7 Claims, 2 Drawing Sheets

TWO-LEVEL LOCKING DEVICE, HOPPER CAR BOTTOM DOOR AND HOPPER CAR

FIELD OF THE INVENTION

The present invention relates to the technical field of rail wagons, and particularly relates to a two-level locking device, a hopper car bottom door and a hopper car.

BACKGROUND OF THE INVENTION

Most existing railroad hopper cars adopt box type bottom door structures, and bottom doors are controlled by bottom door opening and closing mechanisms to open and close to achieve an automatic unloading function. Under this structure, the opening, closing and locking of the bottom doors completely depend on the control of the bottom door opening and closing mechanisms. In the case of failure of the bottom door opening and closing mechanisms, the bottom doors are out of effective control and are completely at a free rotation state, and the bottom doors are liable to automatically open due to vibration in a vehicle operation process, resulting in commodity leakage or automatic unloading to affect the traffic safety.

The bottom door opening and closing mechanisms are key components for ensuring the normal unloading of the railroad hopper cars and require convenient opening and closing operations and stable performance, and the existing mechanical impact self-unloading type bottom door opening and closing mechanisms have the above characteristics, thus being widely used on the railroad hopper cars at home and abroad at present. Moreover, corresponding self-locking devices are provided to prevent automatic opening of the bottom doors due to such reasons as vibration and the like or abnormal opening of the bottom doors caused by other factors in a transportation process.

However, the current two-level locking solutions of the hopper cars adopting the mechanical impact self-unloading type bottom door opening and closing mechanisms are based on the locking operation handle principle, which has relatively limited adaptability and cannot meet the requirements of bilaterally opening and closing the bottom doors.

SUMMARY OF THE INVENTION

To solve the above problems, the present invention provides a two-level locking device arranged on a hopper car bottom door, which is opened and closed by a planar four-bar linkage passing a dead point, a hopper car bottom door including the two-level locking device and a hopper car including the bottom door.

The two-level locking device provided by the present invention includes a first transmission shaft, a second transmission shaft, a clutch, a pressure mechanism and a reset mechanism, wherein under the pressure action of the pressure mechanism, the clutch separates the first transmission shaft from the second transmission shaft, and under the action of the reset mechanism, the clutch joints the first transmission shaft with the second transmission shaft.

Preferably, the clutch includes a locking key limiting seat and a locking key, wherein the locking key limiting seat is fixedly connected to the first transmission shaft, the locking key is fixedly connected to the second transmission shaft, and the pressure mechanism can apply a pressure to the locking key to deviate the locking key from the key slot of the locking key limiting seat, so that the first transmission shaft is separated from the second transmission shaft; the reset mechanism can apply a force to the locking key to insert the locking key into the locking key limiting seat again, so that the first transmission shaft and the second transmission shaft are re-jointed to reset.

Preferably, the pressure mechanism includes a pressure lever, a first bent lever, a first rotating shaft, a force application arm and a force application unit, wherein the pressure lever includes an end m and an end n, the first bent lever includes an end a and an end b, the end m of the pressure lever is hinged with the locking key, the end a of the first bent lever is connected to the end n of the pressure lever, the first bent lever is connected to the force application arm through the first rotating shaft, the force application unit can apply an upward acting force to the end b of the first bent lever, such that the first bent lever rotates clockwise with the first rotating shaft as the shaft to propel the pressure lever to move rightwards, and the pressure lever applies a rightward acting force to the locking key to deviate the locking key from the key slot of the locking key limiting seat, so that the first transmission shaft is separated from the second transmission shaft.

Preferably, the force application unit includes a first roller, a first locating pin and a first connecting piece, wherein a first through hole and a first slotted hole are formed on the force application arm, a second through hole and a third through hole are formed on the first connecting piece, a fourth through hole is formed on the first roller, the end b of the first bent lever sequentially penetrates through the first through hole and the second through hole, the first locating pin is inserted in the second through hole, the fourth through hole and the first slotted hole, when the first locating pin is located at the lower semicircle of the first slotted hole, the lower edge of the first roller protrudes from the force application arm to apply an upward acting force to the first roller, the first roller drives the first locating pin to move upwards, the first locating pin drives the first connecting piece to move upwards, and the first connecting piece applies an upward acting force to the end b of the first bent lever, until the first locating pin arrives at the upper semicircle of the first slotted hole.

Preferably, the reset mechanism includes a pull rod, a stop dog, an elastic component, a second bent lever, a second rotating shaft, a third rotating shaft, a plug, a reset arm and a limiting unit, wherein the pull rod includes an end p and an end q, the second bent lever includes an end c and an end d, the end p of the pull rod is hinged with the locking key, the end q of the pull rod is connected to the end c of the second bent lever through the third rotating shaft, the second bent lever is connected to the reset arm through the second rotating shaft, a holding space for the movement of the end q of the pull rod, the third rotating shaft and the end c of the second bent lever is arranged in the plug, the stop dog is fixedly connected to the pull rod, one end of the elastic component is fixedly connected to the stop dog, the other end of the elastic component is fixedly connected to the plug, when the locking key is jointed with the locking key limiting seat, the reset arm can prevent the second bent lever from rotating counterclockwise with the second rotating shaft as the shaft, and at this time, the elastic component is at a tensile state.

Preferably, the limiting unit includes a second roller, a second locating pin and a second connecting piece, wherein a fifth through hole and a second slotted hole are formed on the reset arm, a sixth through hole and a seventh through hole are formed on the second connecting piece, an eighth through hole is formed on the second roller, the end d of the second bent lever sequentially penetrates through the fifth through hole and the sixth through hole, the second locating pin is inserted in the sixth through hole, the eighth through hole and the second slotted hole, when the locking key is jointed with the locking key limiting seat, the second locating pin is located at the upper semicircle of the second slotted hole, and the upper semicircle of the second slotted hole prevents the second locating pin from moving upwards to prevent the second connecting piece from moving upwards, so as to prevent the second bent lever from rotating counterclockwise with the second rotating shaft as the shaft.

The present invention further provides a hopper car bottom door, including the two-level locking device provided by the present invention, wherein the force application arm is the first door opening and closing arm of the bottom door, and the reset arm is the second door opening and closing arm of the bottom door.

The present invention further provides a hopper car, including the hopper car bottom door provided by the present invention.

According to the two-level locking mechanism provided by the present invention, when the clutch is accidently separated by the pressure action of the pressure mechanism, the reset mechanism can re-joint the clutch to prevent the accidental rotation of the first transmission shaft and the second transmission shaft.

The hopper car bottom door provided by the present invention includes the two-level locking device provided by the present invention, when the first door opening and closing arm and the second door opening and closing arm vibrate to cause accidental separation of the clutch to result in accidental opening of the first door opening and closing arm and the second door opening and closing arm, the reset mechanism can re-joint the clutch to prevent the transmission shafts from rotating, in order to prevent the accidental opening of the first door opening and closing arm and the second door opening and closing arm, so that the hopper car bottom door opened and closed by the planar four-bar linkage passing the dead point is more reliable to use.

The hopper car provided by the present invention includes the hopper car bottom door provided by the present invention, and the accidental opening of the first door opening arm and the second door opening arm can be prevented, so that the application is more reliable.

DETAILED DESCRIPTION OF THE EMBODIMENTS

To better understand the present invention, a detailed illustration of the present invention will be given below in combination with accompanying drawings and specific embodiments.

Figure 1:
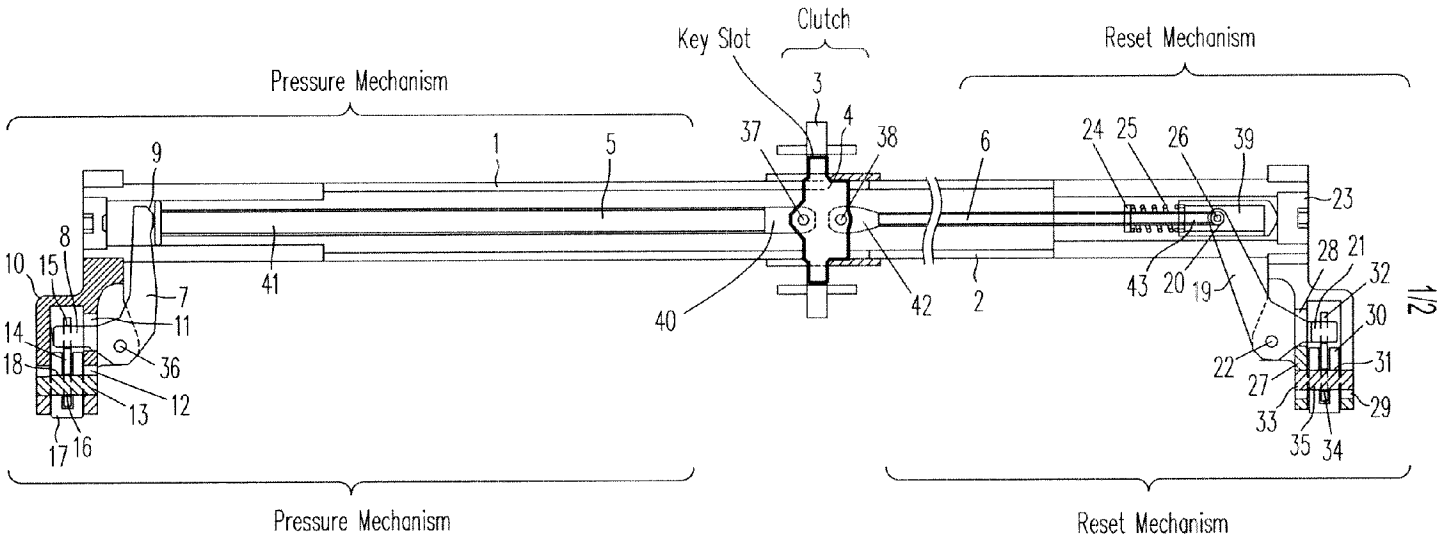
FIG. 1 is a schematic diagram of a structure when a locking key is inserted in a locking key limiting seat of a two-level locking device provided by an embodiment of the present invention.
Figure 2:
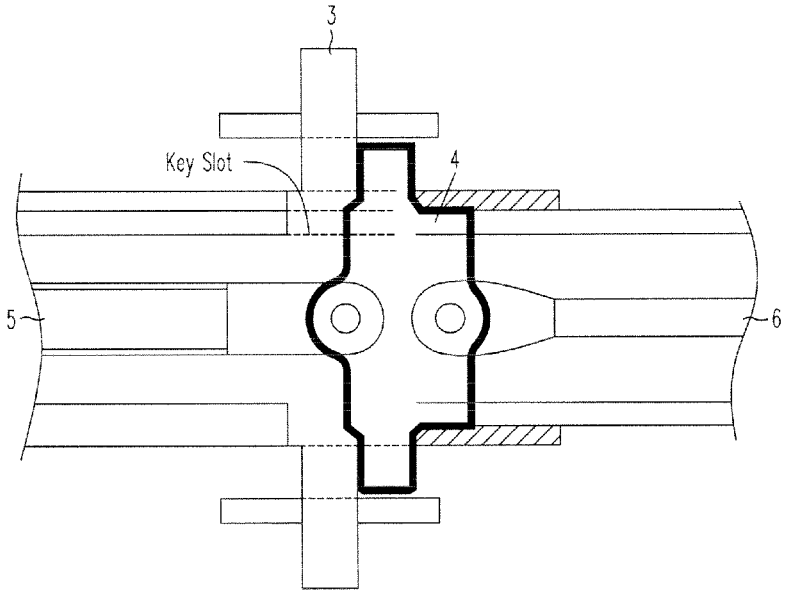
FIG. 2 is a schematic diagram of a structure when a locking key is separated from a locking key limiting seat of a two-level locking device provided by an embodiment of the present invention.

See FIG. 1 and FIG. 2, a two-level locking device provided by the present invention includes a first transmission shaft 1, a second transmission shaft 2, a clutch, a pressure mechanism and a reset mechanism, wherein under the pressure action of the pressure mechanism, the clutch separates the first transmission shaft 1 from the second transmission shaft 2, and under the action of the reset mechanism, the clutch joints the first transmission shaft 1 with the second transmission shaft 2.

According to the two-level locking mechanism provided by the present invention, when the clutch is accidently separated by the pressure action of the pressure mechanism, the reset mechanism can re-joint the clutch to prevent the accidental rotation of the first transmission shaft 1 and the second transmission shaft 2.

Wherein as a specific implementation of the clutch, the clutch includes a locking key limiting seat 3 and a locking key 4, wherein the locking key limiting seat 3 is fixedly connected to the first transmission shaft 1, the locking key 4 is fixedly connected to the second transmission shaft 2, in this embodiment, the locking key 4 is not fixedly connected to the second transmission shaft 2 completely, while the locking key 4 is buckled on the second transmission shaft 2 by the tension of an elastic component 25, such that the locking key 4 is fixedly connected to the second transmission shaft 2. The pressure mechanism can apply a pressure to the locking key 4 to deviate the locking key 4 from the key slot of the locking key limiting seat 3, so that the first transmission shaft 1 is separated from the second transmission shaft 2; in this embodiment, since the tension applied by the elastic component 25 to the locking key 4 is not a rigid acting force, but is an elastic pre-tightening force with a buffering effect, the elastic pre-tightening force is insufficient to deviate the locking key 4 from the key slot of the locking key limiting seat 3, however, the pressure applied by the pressure mechanism to the locking key 4 is a rigid acting force, and the rigid acting force is sufficient to deviate the locking key 4 from the key slot of the locking key limiting seat 3. The reset mechanism can apply a force to the locking key 4 to insert the locking key 4 into the locking key limiting seat 3 again, so that the first transmission shaft 1 and the second transmission shaft 2 are re-jointed to reset.

Wherein as a specific implementation of the pressure mechanism, the pressure mechanism includes a pressure lever 5, a first bent lever 7, a first rotating shaft 36, a force application arm 10 and a force application unit, wherein the pressure lever 5 includes an end m 40 and an end n 41, the first bent lever 7 includes an end a 9 and an end b 8, the end m 40 of the pressure lever 5 is hinged with the locking key 4, the hinge point is 37, the end a 9 of the first bent lever 7 is connected to the end n 41 of the pressure lever 5, the first bent lever 7 is connected to the force application arm 10 through the first rotating shaft 36, the force application unit can apply an upward acting force to the end b 8 of the first bent lever 7, such that the first bent lever 7 rotates clockwise with the first rotating shaft 36 as the shaft to propel the pressure lever 5 to move rightwards, and the pressure lever 5 applies a rightward acting force to the locking key 4 to deviate the locking key 4 from the key slot of the locking key limiting seat 3, so that the first transmission shaft 1 is separated from the second transmission shaft 2.

Wherein as a specific implementation of the force application unit, the force application unit includes a first roller 17, a first locating pin 13 and a first connecting piece 14, wherein a first through hole 11 and a first slotted hole 12 are formed on the force application arm 10, a second through hole 15 and a third through hole 16 are formed on the first connecting piece 14, a fourth through hole 18 is formed on the first roller 17, the end b 8 of the first bent lever 7 sequentially penetrates through the first through hole 11 and the second through hole 15, the first locating pin 13 is inserted in the second through hole 15, the fourth through hole 18 and the first slotted hole 12, when the first locating pin 13 is located at the lower semicircle of the first slotted hole 12, the lower edge of the first roller 17 protrudes from the force application arm 10 to apply an upward acting force to the first roller 17, the first roller 17 drives the first locating pin 13 to move upwards, the first locating pin 13 drives the first connecting piece 14 to move upwards, and the first connecting piece 14 applies an upward acting force to the end b 8 of the first bent lever 7, until the first locating pin 13 arrives at the upper semicircle of the first slotted hole 12.

In this embodiment, the first connecting piece 14 is inserted in the groove of the first roller 17, and the first roller 17 is inserted in the groove of the force application arm 10, so that the structure of the force application unit is more compact.

Wherein as a specific implementation of the reset mechanism, the reset mechanism includes a pull rod 6, a stop dog 24, an elastic component 25 (in this embodiment, the elastic component is 15), a second bent lever 19, a second rotating shaft 22, a third rotating shaft 26, a plug 23, a reset arm 27 and a limiting unit, wherein the pull rod 6 includes an end p 42 and an end q 43, the second bent lever 19 includes an end c 20 and an end d 21, the end p 42 of the pull rod 6 is hinged with the locking key 4, the end q 43 of the pull rod 6 is connected to the end c 20 of the second bent lever 19 through the third rotating shaft 26, the second bent lever 19 is connected to the reset arm 27 through the second rotating shaft 22, a holding space 39 for the movement of the end q 43 of the pull rod 6, the third rotating shaft 26 and the end c 20 of the second bent lever 19 is arranged in the plug 23, the stop dog 24 is fixedly connected to the pull rod 6, one end of the elastic component 25 is fixedly connected to the stop dog 24, the other end of the elastic component 25 is fixedly connected to the plug 23, when the locking key 4 is jointed with the locking key limiting seat 3, the reset arm 27 can prevent the second bent lever 19 from rotating counterclockwise with the second rotating shaft 22 as the shaft, and at this time, the elastic component 25 is at a tensile state.

Wherein, the limiting unit includes a second roller 30, a second locating pin 35 and a second connecting piece 32, a fifth through hole 28 and a second slotted hole 29 are formed on the reset arm 27, a sixth through hole 33 and a seventh through hole 34 are formed on the second connecting piece 32, an eighth through hole 31 is formed on the second roller 30, the end d 21 of the second bent lever 19 sequentially penetrates through the fifth through hole 28 and the sixth through hole 33, the second locating pin 35 is inserted in the sixth through hole 33, the eighth through hole 31 and the second slotted hole 29, when the locking key 4 is jointed with the locking key limiting seat 3, the second locating pin 35 is located at the upper semicircle of the second slotted hole 29, and the upper semicircle of the second slotted hole 29 prevents the second locating pin 35 from moving upwards to prevent the second connecting piece 32 from moving upwards, so as to prevent the second bent lever 19 from rotating counterclockwise with the second rotating shaft 22 as the shaft.

In this embodiment, the second connecting piece 32 is inserted in the groove of the second roller 30, and the second roller 30 is inserted in the groove of the reset arm 27, so that the structure of the limiting unit is more compact.

The present invention further provides a hopper car bottom door, including the two-level locking device provided by the present invention, wherein the force application arm 10 is the first door opening and closing arm of the bottom door, and the reset arm 27 is the second door opening and closing arm of the bottom door.

The hopper car bottom door provided by the present invention has the two-level locking device provided by the present invention, when the first door opening and closing arm and the second door opening and closing arm vibrate to cause accidental separation of the clutch to result in accidental opening of the first door opening and closing arm and the second door opening and closing arm, the reset mechanism can re-joint the clutch to prevent the transmission shafts from rotating, in order to prevent the accidental opening of the first door opening and closing arm and the second door opening and closing arm, so that the hopper car bottom door opened and closed by the planar four-bar linkage passing the dead point is more reliable to use.

The present invention further provides a hopper car, including the hopper car bottom door provided by the present invention.

The hopper car provided by the present invention has the hopper car bottom door provided by the present invention, and the accidental opening of the first door opening arm and the second door opening arm can be prevented, so that the application is more reliable.

In an operation process of the hopper car provided by the present invention, a ground door opening ramp acts on the first door opening and closing arm, the first roller 17 is applied with the upward acting force at first, the first roller 17 drives the first locating pin 13 to move upwards, the first locating pin 13 drives the first connecting piece 14 to move upwards, the first connecting piece 14 applies the upward acting force to the end b 8 of the first bent lever 7, until the first locating pin 13 arrives at the upper semicircle of the first slotted hole 12, the locking key 4 deviates from the key slot of the locking key limiting seat 3, the elastic component 25 changes from the tensile state into a compressed state, and the first transmission shaft 1 is separated from the second transmission shaft 2, however, when the hopper car operates reversely, the upward acting force applied on the first roller 17 gradually disappears, at this time, the elastic component 25 gradually recovers from the compressed state, the first locating pin 13, the first roller 17 and the first connecting piece 14 drive the pressure lever 1 to move leftwards under the action of self-gravity, the pressure lever 1 in turn drives the locking key 4 to move leftwards to be inserted into the locking key limiting seat 3 again, and the first transmission shaft 1 and the second transmission shaft 2 are re-jointed to reset.

The foregoing specific implementations are further detailed descriptions of the purposes, technical solutions and beneficial effects of the present invention, and it should be understood that, the foregoing descriptions are merely specific implementations of the present invention, rather than limiting the present invention. Any modifications, equivalent substitutions and improvements or the like made within the spirit and principle of the present invention shall fall within the protection scope of the present invention.

The invention claimed is:

1. A two-level locking device, comprising:

a first transmission shaft;

a second transmission shaft;

a clutch;

a pressure mechanism; and a reset mechanism, wherein the clutch comprises a locking key limiting seat and a locking key, wherein the locking key limiting seat has a key slot and is fixedly connected to the first transmission shaft, the locking key is fixedly connected to the second transmission shaft, wherein the pressure mechanism can apply a pressure to the locking key to deviate the locking key from the key slot of the locking key limiting seat, so that the first transmission shaft is separated from the second transmission shaft, and wherein the reset mechanism can apply a force to the locking key to insert the locking key into the locking key limiting seat again, so that the first transmission shaft and the second transmission shaft are re-jointed to reset.

2. The device of claim 1, wherein the pressure mechanism comprises a pressure lever, a first bent lever, a first rotating shaft, a force application arm and a force application unit, wherein the pressure lever comprises an end m and an end n, the first bent lever comprises an end a and an end b, the end m of the pressure lever is hinged with the locking key, the end a of the first bent lever is connected to the end n of the pressure lever, the first bent lever is connected to the force application arm through the first rotating shaft, the force application unit can apply an upward acting force to the end b of the first bent lever, such that the first bent lever rotates clockwise with the first rotating shaft as the shaft to propel the pressure lever to move rightwards, and the pressure lever applies a rightward acting force to the locking key to deviate the locking key from the key slot of the locking key limiting seat, so that the first transmission shaft is separated from the second transmission shaft.

3. The device of claim 2, wherein the force application unit comprises a first roller, a first locating pin and a first connecting piece, wherein a first through hole and a first slotted hole are formed on the force application arm, a second through hole and a third through hole are formed on the first connecting piece, a fourth through hole is formed on the first roller, the end b of the first bent lever sequentially penetrates through the first through hole and the second through hole, the first locating pin is inserted in the second through hole, the fourth through hole and the first slotted hole, when the first locating pin is located at the lower semicircle of the first slotted hole, the lower edge of the first roller protrudes from the force application arm to apply an upward acting force to the first roller, the first roller drives the first locating pin to move upwards, the first locating pin drives the first connecting piece to move upwards, and the first connecting piece applies an upward acting force to the end b of the first bent lever, until the first locating pin arrives at the upper semicircle of the first slotted hole.

4. The device of claim 1, wherein the reset mechanism comprises a pull rod, a stop dog, an elastic component, a second bent lever, a second rotating shaft, a third rotating shaft, a plug, a reset arm and a limiting unit, wherein the pull rod comprises an end p and an end q, the second bent lever comprises an end c and an end d, the end p of the pull rod is hinged with the locking key, the end q of the pull rod is connected to the end c of the second bent lever through the third rotating shaft, the second bent lever is connected to the reset arm through the second rotating shaft, a holding space for the movement of the end q of the pull rod, the third rotating shaft and the end c of the second bent lever is arranged in the plug, the stop dog is fixedly connected to the pull rod, one end of the elastic component is fixedly connected to the stop dog, the other end of the elastic component is fixedly connected to the plug, when the locking key is jointed with the locking key limiting seat, the reset arm can prevent the second bent lever from rotating counterclockwise with the second rotating shaft as the shaft, and at this time, the elastic component is at a tensile state.

5. The device of claim 4, wherein the limiting unit comprises a second roller, a second locating pin and a second connecting piece, wherein a fifth through hole and a second slotted hole are formed on the reset arm, a sixth through hole and a seventh through hole are formed on the second connecting piece, an eighth through hole is formed on the second roller, the end d of the second bent lever sequentially penetrates through the fifth through hole and the sixth through hole, the second locating pin is inserted in the sixth through hole, the eighth through hole and the second slotted hole, when the locking key is jointed with the locking key limiting seat, the second locating pin is located at the upper semicircle of the second slotted hole, and the upper semicircle of the second slotted hole prevents the second locating pin from moving upwards to prevent the second connecting piece from moving upwards, so as to prevent the second bent lever from rotating counterclockwise with the second rotating shaft as the shaft.

6. A hopper car bottom door, comprising the two-level locking device of claim 1, wherein the pressure mechanism is a first door opening and closing arm of the bottom door, and the reset mechanism is a second door opening and closing arm of the bottom door.

7. A hopper car, comprising the hopper car bottom door of claim 6.

* * * * *